US009860944B2

(12) United States Patent
Akiyama et al.

(10) Patent No.: US 9,860,944 B2
(45) Date of Patent: Jan. 2, 2018

(54) LED DRIVER CIRCUIT

(71) Applicants: CITIZEN ELECTRONICS CO., LTD., Fujiyoshida-shi, Yamanashi (JP); CITIZEN WATCH CO., LTD., Nishitokyo-shi (JP)

(72) Inventors: Takashi Akiyama, Fujiyoshida (JP); Tatsuro Yamada, Fujiyoshida (JP); Satoshi Goto, Fujiyoshida (JP)

(73) Assignees: CITIZEN ELECTRONICS CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/510,431

(22) PCT Filed: Sep. 11, 2015

(86) PCT No.: PCT/JP2015/075890
§ 371 (c)(1),
(2) Date: Mar. 10, 2017

(87) PCT Pub. No.: WO2016/039457
PCT Pub. Date: Mar. 17, 2016

(65) Prior Publication Data

US 2017/0290111 A1 Oct. 5, 2017

(30) Foreign Application Priority Data

Sep. 12, 2014 (JP) ..... 2014-186800

(51) Int. Cl.
*H05B 33/08* (2006.01)
*H05B 37/02* (2006.01)

(52) U.S. Cl.
CPC ..... *H05B 33/0812* (2013.01); *H05B 33/0827* (2013.01); *H05B 33/0845* (2013.01); *H05B 33/0857* (2013.01); *H05B 37/02* (2013.01)

(58) Field of Classification Search
CPC ..... H05B 33/083; H05B 33/0803; H05B 33/0815; H05B 33/0827; H05B 33/0809;
(Continued)

(56) References Cited

U.S. PATENT DOCUMENTS 8,242,704 B2 * 8/2012 Lethellier ..... H05B 33/0815 315/276
9,232,590 B2 * 1/2016 Grajcar ..... H05B 33/0809
(Continued)

FOREIGN PATENT DOCUMENTS

JP 2013502082 A 1/2013
JP 2014086694 A 5/2014
(Continued)

OTHER PUBLICATIONS

Written Opinion of the International Searching Authority for International Application No. PCT/JP2015/075890, dated Nov. 2, 2015, 10 pages.
(Continued)

*Primary Examiner* — Haissa Philogene
(74) *Attorney, Agent, or Firm* — RatnerPrestia

(57) ABSTRACT

The purpose of the present invention is to provide an LED driving circuit with which it is possible to easily manage the color temperature by adjusting light. An LED driving circuit, characterized in having: a first LED group in which a plurality of first LEDs are serially connected, the first LED group contributing to emission of light having a first color temperature; a second LED group in which a plurality of second LEDs are serially connected, the second LED group contributing to emission of light having a second color temperature; a third LED group in which a plurality of second LEDs are serially connected, the second LED group contributing to emission of light having the second color temperature; and a control unit for switching, in response to
(Continued)

an increase in a rectified output voltage, from illumination of only the first LED group to illumination of only the second LED group and then from illumination of only the second LED group to illumination of the second LED group and the third LED group, the number of first LEDs included in the first LED group being less than the number of second LEDs included in the second LED group.

6 Claims, 9 Drawing Sheets

(58) Field of Classification Search
CPC H05B 33/0842; H05B 33/0821; H05B 37/02; Y02B 20/346; F21Y 2115/10
USPC ... 315/192, 185 R, 186, 188, 291, 294, 307, 315/312
See application file for complete search history.

(56) References Cited

U.S. PATENT DOCUMENTS

| | | | | |
|---|---|---|---|---|
| 9,380,665 | B2 * | 6/2016 | Grajcar ..... | H05B 33/0809 |
| 9,450,505 | B2 * | 9/2016 | Siessegger ..... | H05B 33/0803 |
| 2014/0197751 | A1 | 7/2014 | Grajcar | |
| 2014/0210357 | A1 | 7/2014 | Yan et al. | |

FOREIGN PATENT DOCUMENTS

| | | | |
|---|---|---|---|
| JP | 2014516452 | A | 7/2014 |
| JP | 2014146595 | A | 8/2014 |

OTHER PUBLICATIONS

International Search Report and Written Opinion for International Application No. PCT/JP2015/075890, dated Nov. 2, 2015, 8 Pages.

* cited by examiner

LED DRIVER CIRCUIT

CROSS REFERENCE TO RELATED APPLICATIONS

This is the U.S. National Phase application of PCT/JP2015/075890, filed Sep. 11, 2015 and claims priority to Japanese Patent Application No. 2014-186800, filed Sep. 12, 2014, the disclosures of these applications being incorporated herein by reference in their entireties for all purposes.

FIELD OF THE INVENTION

The present invention relates to an LED driver circuit, and, in particular, relates to an LED driver circuit capable of adjusting an emission color by dimming using an AC source.

BACKGROUND OF THE INVENTION

It is known that lighting equipment has a bridge diode that full-wave rectifies an AC source and applies a rectified output voltage to a plurality of LEDs connected in series and the plurality of LEDs emit light.

An LED light source engine including an LED group 1 and an LED group 2 having color temperatures different from each other is known (for example, refer to Patent literature 1). When the LED light source engine modulates light, the color temperature of the entire LED light source engine can be changed based on the light emission behavior of the two types of different LED groups.

PATENT DOCUMENT

Patent literature 1: Published Japanese Translation of PCT International Publication for Patent Application (Kohyo) No. JP-T-2013-502082

SUMMARY OF THE INVENTION

It has not been easy to modulate light so as to obtain a desired color temperature by combining a plurality of LED groups having different light emission behavior by dimming.

It is an object of the present invention to provide an LED driver circuit capable of easily controlling of a color temperature by modulating light.

In addition, it is an object of the present invention to provide an LED driver circuit capable of easily controlling of a red tinge by modulating light.

An LED driver circuit turns on LEDs by a rectified output voltage obtained by full-wave rectifying an alternating current, and includes a first LED group, in which a plurality of first LEDs are connected in series and which contributes to emission of light having a first color temperature, a second LED group, in which a plurality of second LEDs are connected in series and which contributes to emission of light having a second color temperature higher than the first color temperature, a third LED group, in which a plurality of the second LEDs are connected in series and which is connected to the second LED group in series and contributes to the emission of the light having the second color temperature, and a control unit that switches from a condition that only the first LED group is turning-on to a condition that only the second LED group is turning-on, and further, from the condition that only the second LED group is turning-on to a condition that the second LED group and the third LED group are turning-on in response to an increase in the rectified output voltage, wherein the number of the first LEDs included in the first LED group is smaller than the number of the second LEDs included in the second LED group.

In the LED driver circuit, it is preferable to further include a diode bridge rectifier circuit that full-wave rectifies the alternating current to output the rectified output voltage.

In the LED driver circuit, it is preferable to further include a first phosphor-containing resin region that covers the first LED group, and converts a wavelength of light emitted from the first LED group to emit the light having the first color temperature, and a second phosphor-containing resin region that covers the second LED group and the third LED group, and converts a wavelength of light emitted from the second LED group and the third LED group to emit the light having the second color temperature.

In the LED driver circuit, it is preferable that the first LED group and the second LED group be connected in parallel with respect to the diode bridge rectifier circuit.

In the LED driver circuit, it is preferable that the control unit switches from the condition that only the first LED group is turning-on to the condition that only the second LED group is turning-on on the basis of a current flowing in the second LED group.

In the LED driver circuit, it is preferable that a ratio of the number of the first LEDs connected in series and included in the first LED group to the number of the second LEDs connected in series and included in the second LED group be smaller than 1:3.

In the above-described LED driver circuit, the control unit provide a condition that the first LED group and the second LED group are turning-on during a switching period from the condition that only the first LED group is turning-on to the condition that only the second LED group is turning-on in response to the increase in the rectified output voltage. The light emission time of the first LED group is lengthened with respect to the entire light emission period during low-rate dimming, and thus, the first color temperature is dominant. In addition, the amount of light emission at a low color temperature is smaller than the amount of light emission at a high color temperature, and thus, the second color temperature is dominant during 100% dimming. Therefore, a desired color temperature is easy to be set during 100% dimming, and the management of an emission color becomes easy.

In addition, in the above-described LED driver circuit, light emission is switched from the first LEDs that contribute to light emission of light having a low color temperature that is small in the amount of light emission to the second LEDs that contribute to light emission of light having a high color temperature that is large in the amount of light emission in association with the increase in the rectified output voltage, and thus, a red tinge by modulating can be easily controlled.

BRIEF DESCRIPTION OF THE DRAWINGS

FIG. 2(*b*) is a diagram illustrating one example of an output voltage waveform 31 of a full-wave rectifier diode bridge circuit 22.

FIG. 2(*c*) is an output voltage waveform 33 of the full-wave rectifier diode bridge circuit 22 based on a dimmer output voltage 32.

FIG. 3(*b*) is a cross-sectional view of FIG. 3(*a*) along AA'.

FIG. 3(*c*) is a front view of the LED light emission device 200.

FIG. 3(*d*) is a right side view of the LED light emission device 200.

FIG. 7(*b*) is a plan view of an LED light emission device 220 according to another embodiment of the present invention and a cross-sectional view thereof along CC'.

FIG. 7(*c*) is a plan view of an LED light emission device 230 according to another embodiment of the present invention and a cross-sectional view thereof along DD'.

DETAILED DESCRIPTION OF EMBODIMENTS OF THE INVENTION

An LED driver circuit according to embodiments of the present invention will be described below with reference to the drawings. However, it should be noted that the technical scope of the present invention is not limited to these embodiments but extends to the inventions described in claims and their equivalents.

Figure 1:
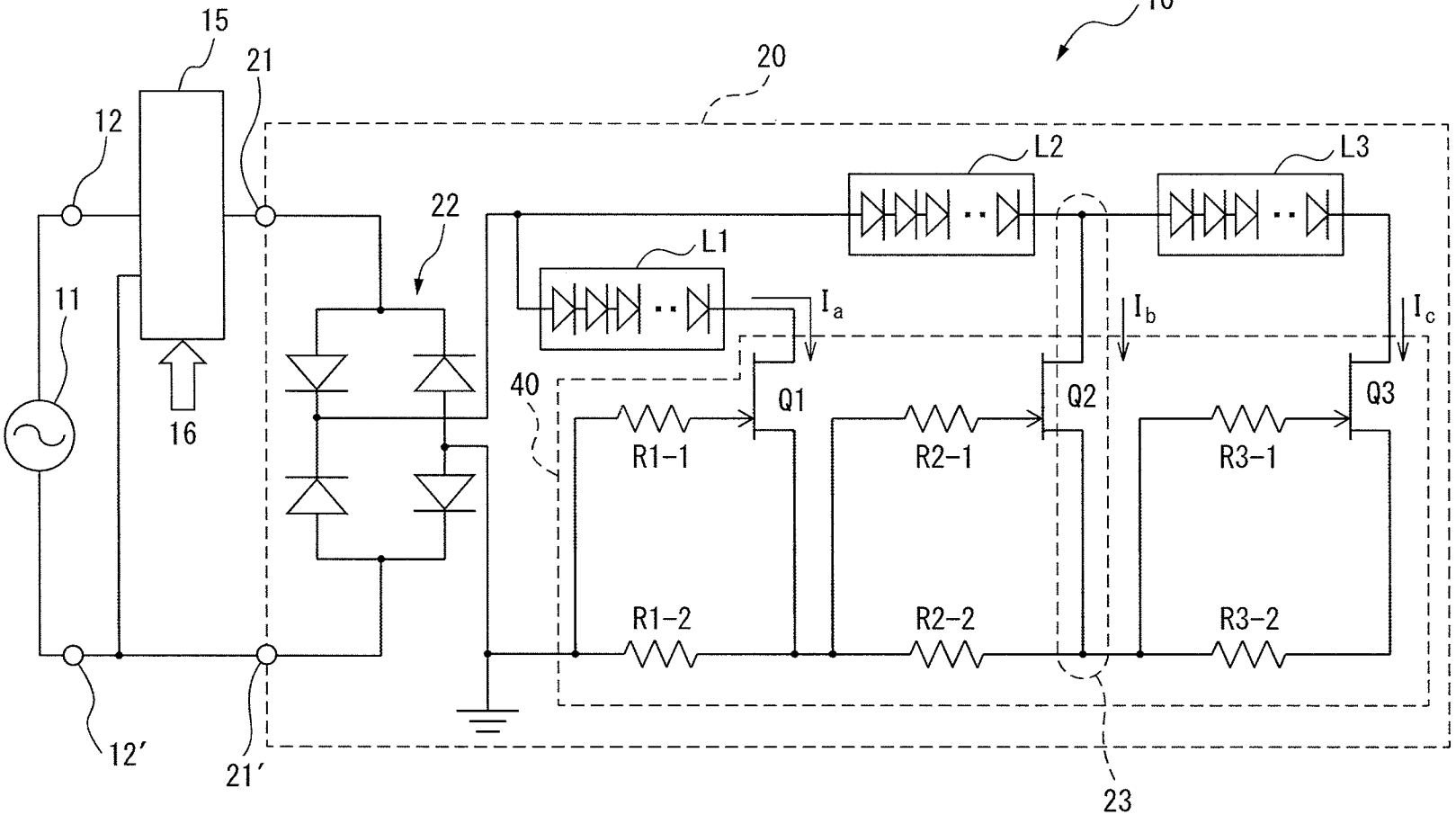
FIG. 1 is a circuit diagram of an LED driver system 10 according to and embodiment of the present invention.

FIG. 1 is a circuit diagram of an LED driver system 10 according to an embodiment of the present invention.

The LED driver system 10 is composed of connection terminals 12 and 12' connected to a commercial AC source (AC 120 V) 11, a phase control dimmer unit 15, an LED driver circuit 20, and the like.

The LED driver circuit 20 includes an anode terminal 21, a cathode terminal 21', a full-wave rectifier diode bridge circuit 22, a first LED group L1 in which 10 first LEDs are connected in series, a second LED group L2 in which 35 second LEDs are connected in series, a third LED group L3 in which 10 second LEDs are connected in series, a bypass pathway 23, and a control unit 40. The first LED group L1 and the second LED group L2 are connected in parallel with respect to the output of the full-wave rectifier diode bridge circuit 22, and the second LED group L2 and the third LED group L3 are connected in series with respect to the output of the full-wave rectifier diode bridge circuit 22.

The control unit 40 is composed of N-type depletion MOSFETs (hereinafter simply referred to as "FETs") Q1 to Q3 for controlling turning-on of the first LED group L1, the second LED group L2, and the third LED group L3, various resistors, and the like.

The FET Q1 operates as a current limitation unit that limits a current Ia flowing in the first LED group L1. More specifically, a gate voltage of the FET Q1 is changed through a resistor R1-1 in response to a current flowing in a resistor R1-2, so that ON-OFF state between a drain and a source of the FET Q1 is controlled.

The FET Q2 operates as a current limitation unit that limits a current Ib flowing in the bypass pathway 23 between the second LED group L2 and the third LED group L3. More specifically, a gate voltage of the FET Q2 is changed through a resistor R2-1 in response to a current flowing in a resistor R2-2, so that ON-OFF state between a drain and a source of the FET Q2 is controlled.

The FET Q3 operates as a current limitation unit that limits a current Ic flowing in the third LED group. More specifically, a gate voltage of the FET Q3 is changed through a resistor R3-1 in response to a current flowing in a resistor R3-2, so that the upper value of the current Ic between a drain and a source of the FET Q3 is limited.

Figure 2A:
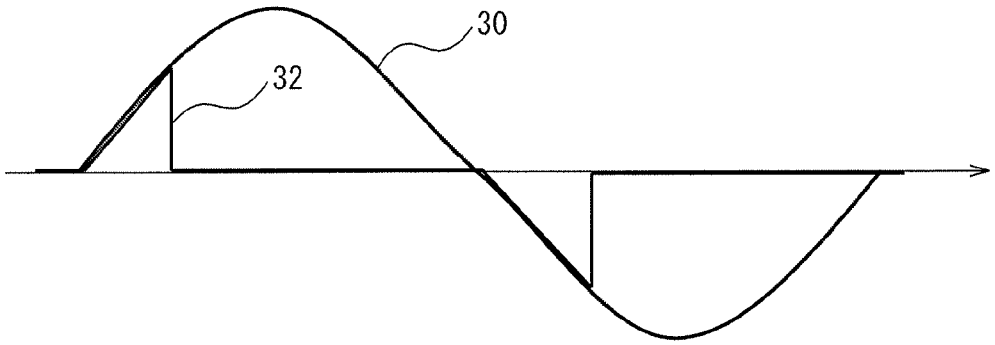
FIG. 2(*a*) is a diagram illustrating one example of a voltage waveform 30 of a commercial AC source (AC 120 V).
Figure 2B:
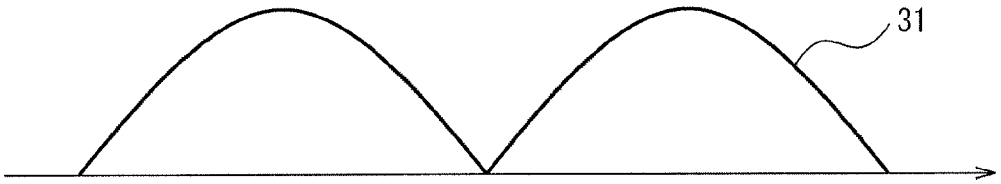
Figure 2C:
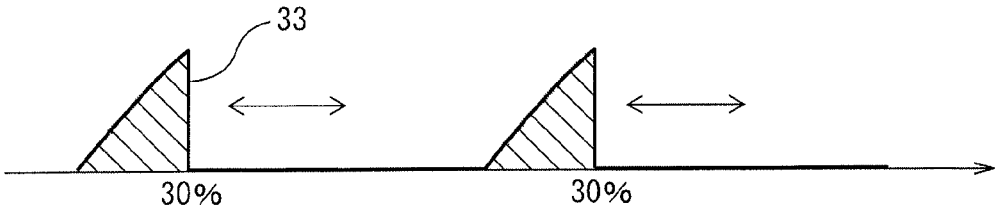
Figure 3A:
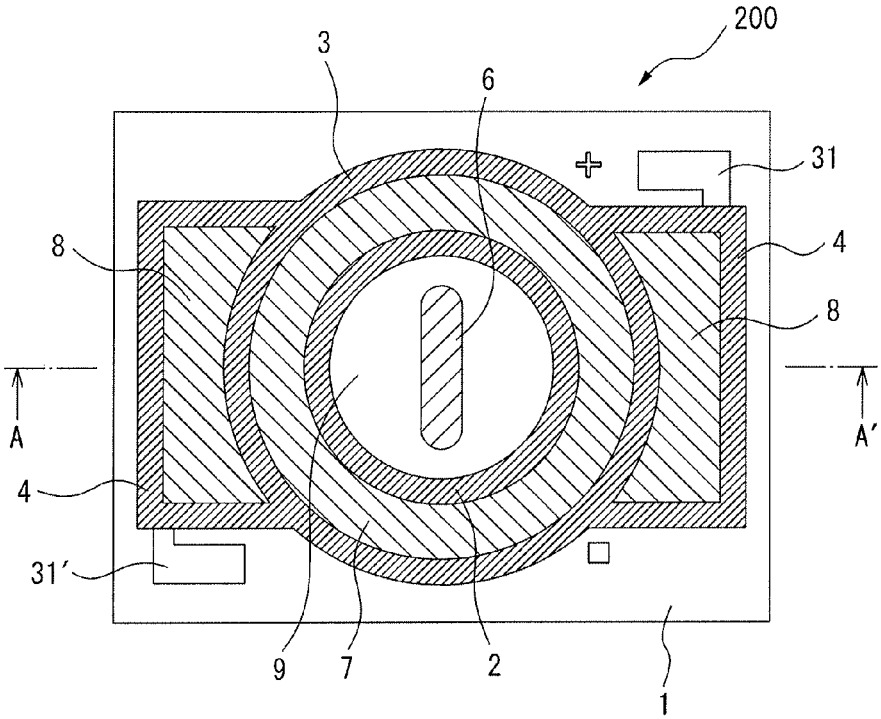
FIG. 3(*a*) illustrates a plan view of an LED light emission device 200 according to an embodiment of the present invention.
Figure 3D:
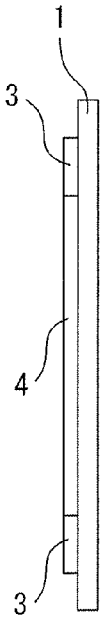
Figure 3B:
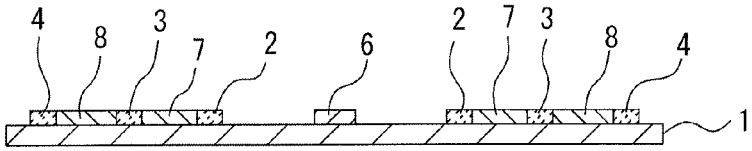
Figure 3C:
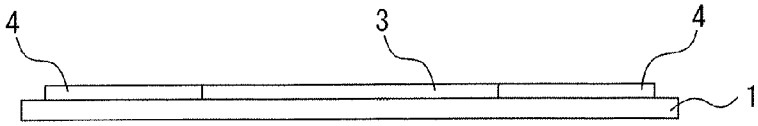

FIGS. 2(*a*) to FIG. 2(*c*) are diagrams for describing the phase control dimmer unit 15.

FIG. 2(*a*) is a diagram illustrating one example of a voltage waveform 30 of the commercial AC source 11 (AC 120 V), FIG. 2(*b*) is a diagram illustrating one example of an output voltage waveform 31 of the full-wave rectifier diode bridge circuit 22, and FIG. 2(*c*) is an output voltage waveform 33 of the full-wave rectifier diode bridge circuit 22 based on a dimmer output voltage 32.

The phase control dimmer unit 15 is a circuit that cuts the crest of the voltage waveform 30 in response to an input control signal 16 to output the dimmer output voltage 32, and, for example, a trailing edge type Triac (registered trademark) dimmer using a Triac (registered trademark) can be used. The dimmer output voltage 32 is illustrated with 70% of the output voltage waveform cut (only 30% passing) by the input control signal 16 (refer to FIG. 2(*a*)). The cutting ratio can be changed from 0% to 100% by the input control signal 16. Therefore, the amount of light emission from the LED driver circuit 20 can be adjusted in response to the input control signal 16.

FIG. 3(*a*) illustrates a plan view of an LED light emission device 200 according to an embodiment of the present invention, FIG. 3(*b*) illustrates a cross-sectional view of FIG. 3(*a*) along AA', FIG. 3(*c*) is a front view of the LED light emission device 200, and FIG. 3(*d*) is a right side view of the LED light emission device 200. A rear view of the LED light emission device 200 and a left side view of the LED light emission device 200 are omitted because these are the same as FIG. 3(*c*) and FIG. 3(*d*), respectively.

The LED light emission device 200 is configured with the LED driver circuit 20 illustrated in FIG. 1 as a light emission device. In the LED light emission device 200, a circular first frame material 2, a second frame material 3 formed concentrically with the first frame material 2 on the outer side of the first frame material 2, a third frame material 4, an anode terminal 31, and a cathode terminal 31' are arranged on a substrate 1. The third frame material 4 is provided so as to configure a part of a rectangle on either side of the second frame material 3 in the drawing so as to be connected to the second frame material 3.

The first frame material 2, the second frame material 3, and the third frame material 4 are formed of a silicone resin into which white particles are mixed. The substrate 1 is composed of a ceramic substrate, and the surface thereof has high reflectivity. In the example of FIG. 3, the first frame material 2 and the second frame material 3 are formed into circular shapes, but may be formed into polygonal annular shapes.

On the inside of the first frame material 2, the 10 first LEDs that configure the first LED group L1 are directly bonded to the substrate 1 with a die bonding material. In a region between the first frame material 2 and the second frame material 3, the 45 second LEDs that configure the second LED group L2 and the third LED group L3 are directly bonded to the substrate 1 with a die bond material. In addition, in regions between the second frame material 3 and the third frame material 4, electronic components, such as the full-wave rectifier diode bridge circuit 22, the FETs, and the resistors illustrated in FIG. 1, are arranged. Although not illustrated in the drawing, electrodes for connecting the LED groups and the like to the anode terminal 31 and the cathode terminal 31' are arranged on the substrate 1.

On the inside of the first frame material 2, a first phosphor-containing resin 6 is formed so as to cover the 10 first LEDs that configure the first LED group L1. The first phosphor-containing resin 6 is not in contact with the first frame material 2, and, as illustrated in FIG. 3(*a*), there is an inner region 9 in which the surface of the substrate 1 is exposed between the first frame material 2 and the first phosphor-containing resin 6.

In the region between the first frame material 2 and the second frame material 3, a second phosphor-containing resin 7 is formed so as to cover the 45 second LEDs that configure the second LED group L2 and the third LED group L3. The second phosphor-containing resin 7 is formed so as to cover the entire region between the first frame material 2 and the second frame material 3. In addition, in the regions between the second frame material 3 and the third frame material 4, the second phosphor-containing resin 8 is formed in the entire region between the second frame material 3 and the third frame material 4 so as to cover the electronic components.

The first LEDs that configure the first LED group L1 and the first phosphor-containing resin 6 are set such that the first phosphor-containing resin 6 absorbs a part of blue light from the first LEDs to emit orange to red light, and light having a color temperature of 1600 K as a whole is emitted. In addition, the second LEDs that configure the second LED group L2 and the third LED group L3 and the second phosphor-containing resin 7 are set such that the second phosphor-containing resin 7 absorbs a part of blue light from the second. LEDs to emit yellow light, and light having a color temperature of 2780 K as a whole is emitted.

The first phosphor-containing resin 6 is set to have a high viscosity compared to the second phosphor-containing resin 7, and thus, is not spread over the whole of the inside of the first frame material 2, and is solidified while maintaining the rod-like state as illustrated in FIG. 1. On the other hand, the second phosphor-containing resin 7 has a relatively low viscosity, and thus, is evenly spread over the region between the first frame material 2 and the second frame material 3 and the regions between the second frame material 3 and the third frame material 4, and is solidified to cover the whole therebetween.

Since the first phosphor-containing resin 6 is arranged so as to just cover the 10 first LEDs that configure the first LED group L1, the surface of the substrate 1 is exposed as the inner region 9 around the first phosphor-containing resin 6. Therefore, when light that has been emitted from the first phosphor-containing resin 6 is emitted obliquely downward (substrate 1 side) with respect to the first phosphor-containing resin 6 or is returned after being reflected at another place, the light is reflected at the surface of the substrate 1, and thus, the light use efficiency becomes high.

Figure 4:
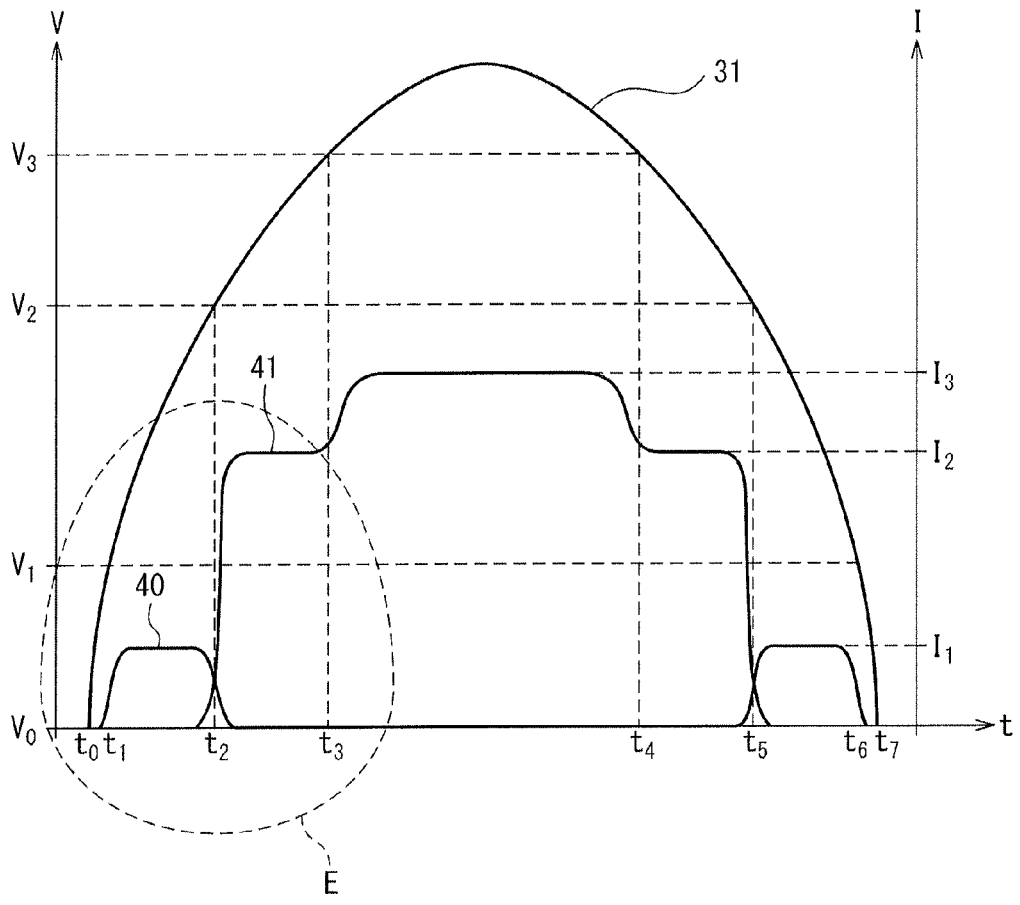
FIG. 4 is a diagram illustrating current waveforms of respective parts of an LED driver circuit 20 and the output voltage waveform 31 of the full-wave rectifier diode bridge circuit 22.

FIG. 4 is a diagram illustrating current waveforms of respective parts of the LED driver circuit 20 and the output voltage waveform 31 of the full-wave rectifier diode bridge circuit 22.

The operation of the LED driver system 10 will be described below with reference to FIG. 4. In FIG. 4, a curve line 40 indicates a waveform of the current Ia flowing in the first LED group L1, and a curve line 41 indicates a waveform of the summed current (Ib+Ic) flowing in the second LED group L2 and the third LED group L3.

Since 10 LEDs are connected in series in the first LED group L1, when a voltage as high as a forward voltage V1 (10×Vf=10×3.2=32 (V)) is applied to the first LED group L1, the LEDs included in the first LED group L1 are turned on. Since 35 LEDs are connected in series in the second LED group L2 that is connected in parallel with the first LED group L1, when a voltage as high as a forward voltage V2 (35×Vf=35×3.2=112 (V)) is applied to the second LED group L2, the LEDs included in the second LED group L2 are turned on. Since 10 LEDs are connected in series in the third LED group L3 that is connected in series with the second LED group L2, when a voltage as high as a forward voltage V3 ((35+10)×Vf=45×3.2=144 (V)) is applied to the second LED group L2 and the third LED group L3, the LEDs included in the second LED group L2 and the third LED group L3 are turned on.

When the output voltage of the full-wave rectifier diode bridge circuit 22 is 0 (V) at time t0 (time t7), the output voltage does not reach a voltage that makes the LEDs in any of the first LED group L1, the second LED group L2, and the third LED group L3 turn on, and thus, all of the LEDs are not turned on.

When the output voltage of the full-wave rectifier diode bridge circuit 22 becomes the forward voltage V1 at time t1, the output voltage is a voltage enough for turning on the first LED group L1, the current Ia starts to flow, and the LEDs included in the first LED group L1 are turned on. At this time, the FET Q1 is in an ON state. At this time, the output voltage is not a voltage enough for turning on the second LED group L2 that is connected in parallel with the first LED group L1, and thus, the LEDs included in the second LED group L2 are not turned on.

When the output voltage of the full-wave rectifier diode bridge circuit 22 becomes the forward voltage V2 at time t2, the output voltage is a voltage enough for turning on the second LED group L2, the current Ib starts to flow in the bypass pathway 23, and the LEDs included in the second LED group L2 are turned on. At this time, the FET Q2 is in an ON state. When the current Ib starts to flow, the current flowing in the resistor R1-2 is increased, the gate voltage of the FET Q1 is decreased in association with a voltage drop across the resistor R1-2, the FET Q1 transitions from the ON state to an OFF state, and the current Ia flowing in the first LED group L1 is limited so as to be decreased sharply. Therefore, the LEDs included in the first LED group L1 are turned off, and the LEDs included in the second LED group L2 are turned on instead.

When the output voltage of the full-wave rectifier diode bridge circuit 22 becomes the forward voltage V3 at time t3, the output voltage is a voltage enough for turning on the second LED group L2 and the third LED group L3, the current Ic starts to flow, and the LEDs included in the second LED group L2 and the third LED group L3 are turned on. At this time, the FET Q3 performs a constant-current operation with feedback of a voltage drop across the resistor R3-2. When the current Ic starts to flow, the current flowing in the resistor R2-2 is increased, the gate voltage of the FET Q2 is decreased in association with a voltage drop across the resistor R2-2, the FET Q2 transitions from the ON state to an OFF state, and the current Ib flowing in the bypass pathway 23 is limited so as to be decreased sharply. Since the current flowing in the resistor R1-2 is increased, the FET Q1 maintains the OFF state, and the LEDs included in the first LED group L1 continue to be turned off.

When the output voltage of the full-wave rectifier diode bridge circuit 22 becomes lower than the forward voltage V3 at time t4, the output voltage is not a voltage enough for turning on the second LED group L2 and the third LED group L3, and the current Ic does not flow. The current flowing in the resistor R2-2 is decreased, the gate voltage of the FET Q2 is increased, the FET Q2 transitions from the OFF state to the ON state, and the current Ib starts to flow in the bypass pathway 23. Accordingly, the LEDs included in the third LED group L3 are turned off, and only the LEDs included in the second LED group L2 are turned on.

When the output voltage of the full-wave rectifier diode bridge circuit 22 becomes lower than the forward voltage V2 at time t5, the output voltage is not a voltage enough for turning on the second LED group L2, and the current Ib does not flow. The current flowing in the resistor R1-2 is decreased, the gate voltage of the FET Q1 is increased, the FET Q1 transitions from the OFF state to the ON state, and the current Ia starts to flow in the first LED group L1. Accordingly, the LEDs included in the second LED group L2 are turned off, and only the LEDs included in the first LED group L1 are turned on.

When the output voltage of the full-wave rectifier diode bridge circuit 22 becomes lower than the forward voltage V1 at time t6, the output voltage is not a voltage enough for turning on the first LED group L1, the current Ia does not flow, and all of the LEDs are turned off. After that, the above-described states are repeated.

As described above, in the LED driver circuit 20, only the first LEDs included in the first LED group L1 are turned on during periods of time t1 to t2 and time t5 to t6. In addition, the second LEDs included in the second LED group L2 are turned on during a period of time t2 to t5, and the second LEDs included in the third LED group L3 are turned on during a period of time t3 to t4.

The number of the first LEDs connected in series and included in the first LED group L1 is 10, and the number of the second LEDs connected in series and included in the second LED group L2 is 35, and thus, the ratio thereof is 1:3.5. The brightness by each of the LED groups is roughly determined by the product of the number of LEDs emitting light and a current. Therefore, the first LED group that emits light at a low current in a low voltage phase and that has a low number of LEDs emits darker light than the second LED group. It was confirmed that dimming-emission color properties similar to those of a filament bulb are obtained when the ratio of the number of the first LEDs connected in series and included in the first LED group L1 to the number of the second LEDs connected in series and included in the second LED group L2 is smaller than 1:3.

As described above, in the LED driver circuit 20, light emission is switched from the first LED group L1 that contributes to light emission of light having a low color temperature that is small in the amount of light emission to the second LED group L2 that contributes to light emission of light having a high color temperature that is large in the amount of light emission in association with an increase in a rectified output voltage, and thus, a red tinge due to the modulation of light can be easily controlled.

In the LED driver circuit 20, the first and second LEDs included in the first, second, and third LED groups L1, L2, L3 are illustrated as LEDs that emit blue light and have a forward drop voltage of 3.2 (V) per one LED. However, the LED driver circuit of the present invention is not limited to the case where the first LEDs included in the first LED group and the second LEDs included in the second LED group have the same forward drop voltage. For example, the first LEDs included in the first LED group may be LEDs whose dies themselves emit red light (so-called red light emitting diodes), and the second LEDs included in the second LED group may be so-called blue light emitting diodes. In this case, the so-called red light emitting diodes have a larger forward drop voltage per one LED than the so-called blue light emitting diodes. In such a case, the number of the first LEDs included in the first LED group is preferably adjusted such that a forward voltage (threshold voltage) of the entire first LED group becomes smaller than a forward voltage (threshold voltage) of the entire second LED group.

Figure 5:
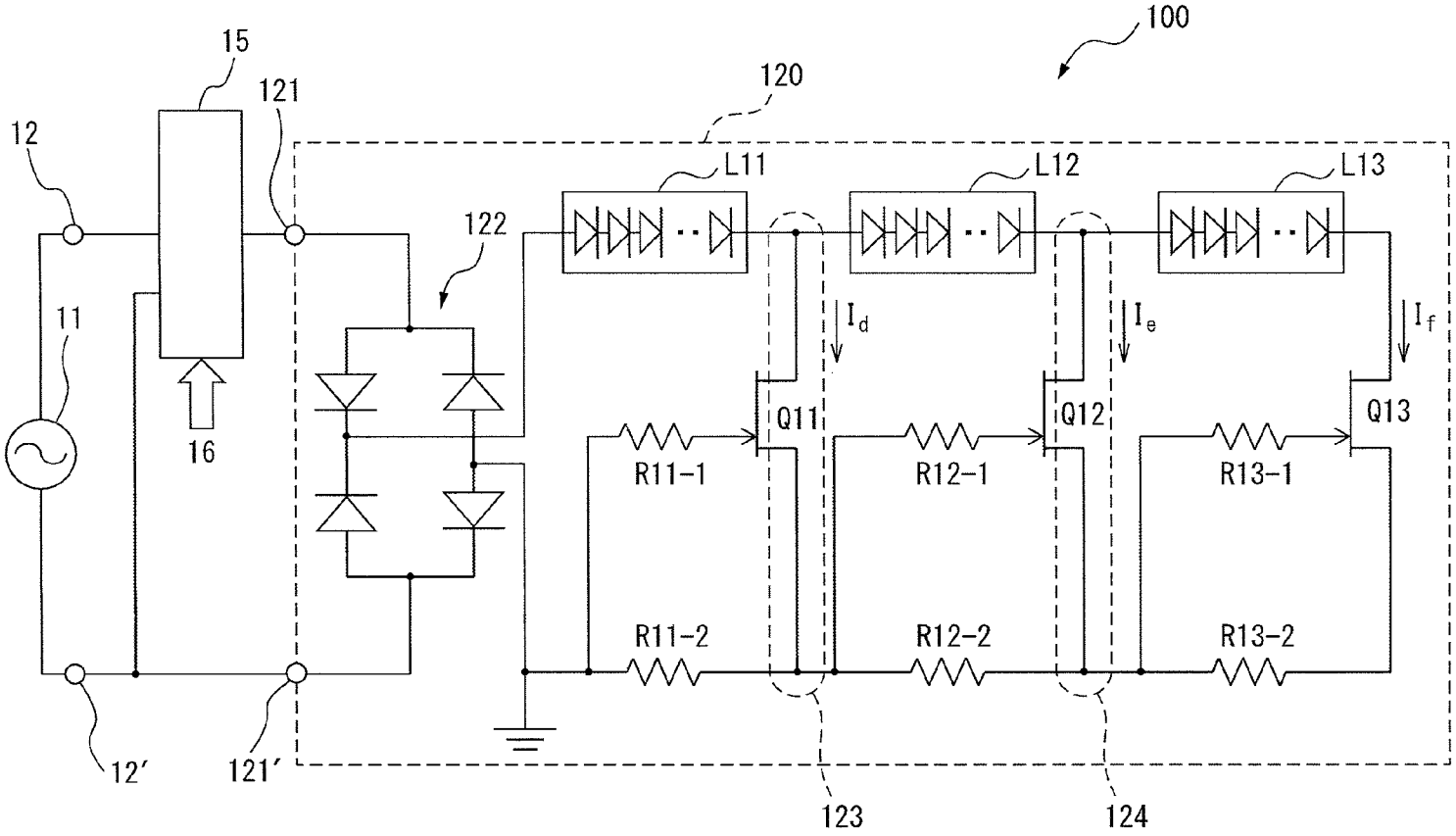
FIG. 5 is a circuit diagram of an LED driver system 100 for comparison.

FIG. 5 is a circuit diagram of an LED driver system 100 for comparison.

The configurations same as those in the LED driver system 10 illustrated in FIG. 1 are denoted by the same reference numerals, and the description thereof is omitted. The LED driver system 100 differs from the LED driver system 10 only in the configuration of an LED driver circuit 120.

The LED driver circuit 120 includes an anode terminal 121, a cathode terminal 121', a full-wave rectifier diode bridge circuit 122, a first LED group L11 in which 10 LEDs are connected in series, a second LED group L12 in which 25 LEDs are connected in series, a third LED group L13 in which 10 LEDs are connected in series, a first bypass pathway 123, a second bypass pathway 124, and the like. The first LED group L11, the second LED group L12, and the third LED group L13 are connected in series with respect to the output of the full-wave rectifier diode bridge circuit 122.

An FET Q11 operates as a current limitation unit that limits a current Id flowing in the first bypass pathway 123 provided between the first LED group L11 and the second LED group L12. More specifically, a gate voltage of the FET Q11 is changed through a resistor R11-1 in response to a current flowing in a resistor R11-2, so that ON-OFF state between a drain and a source of the FET Q11 is controlled.

An FET Q12 operates as a current limitation unit that limits a current Ie flowing in the second bypass pathway 124 provided between the second LED group L12 and the third LED group L13. More specifically, a gate voltage of the FET Q12 is changed through a resistor R12-1 in response to a current flowing in a resistor R12-2, so that ON-OFF state between a drain and a source of the FET Q12 is controlled.

An FET Q13 operates as a current limitation unit that limits a current If flowing in the third LED group L13. More specifically, a gate voltage of the FET Q13 is changed through a resistor R13-1 in response to a current flowing in a resistor R13-2, so that the upper value of the current If between a drain and a source of the FET Q13 is limited.

Figure 6:
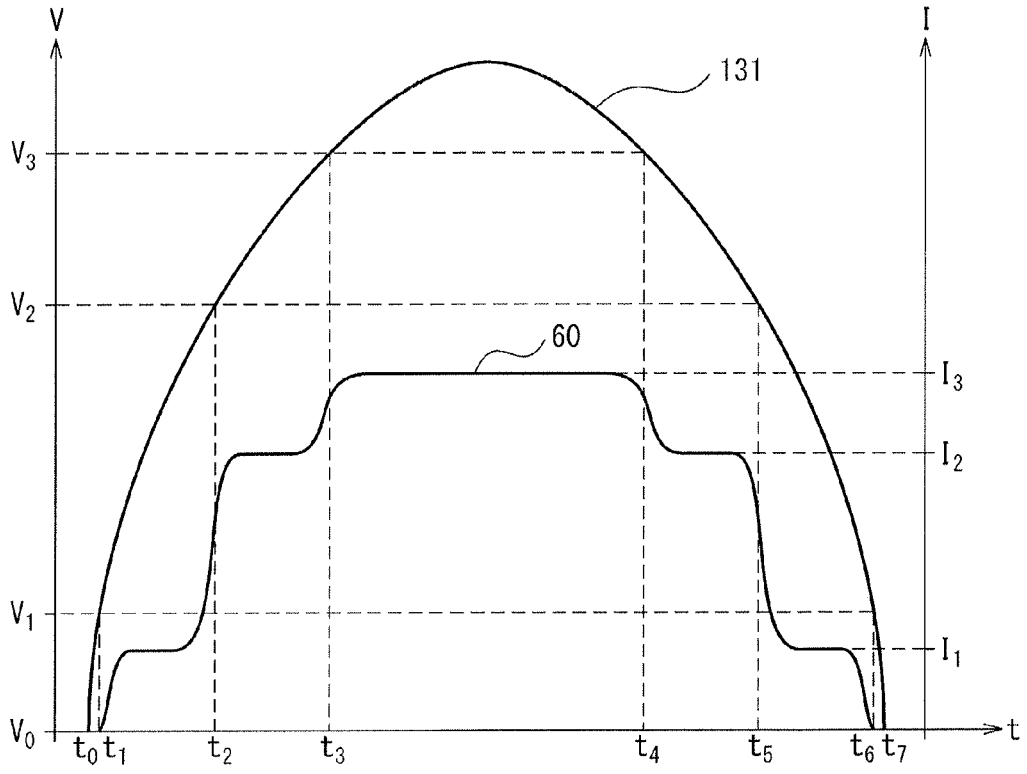
FIG. 6 is a diagram illustrating a current waveform of respective parts of an LED driver circuit 120 and an output voltage waveform 131 of a full-wave rectifier diode bridge circuit 122.

FIG. 6 is a diagram illustrating a current waveform of respective parts of the LED driver circuit 120 and an output voltage waveform 131 of the full-wave rectifier diode bridge circuit 122.

The operation of the LED driver system 100 will be described below with reference to FIG. 6. In FIG. 6, a curve line 60 indicates a waveform of the summed current (Id+Ie+If) flowing in the first LED group L11, the second LED group L12, and the third LED group L13.

Since 10 LEDs are connected in series in the first LED group L11, when a voltage as high as a forward voltage V1 (10×Vf=10×3.2=32 (V)) is applied to the first LED group L11, the LEDs included in the first LED group L11 are turned on. Since 25 LEDs are connected in series in the second LED group L12 that is connected in series with the first LED group L11, when a voltage as high as a forward voltage V2 ((10+25)×Vf=35×3.2=112 (V)) is applied to the first LED group L11 and the second LED group L12, the LEDs included in the first LED group L11 and the second LED group L12 are turned on. Since 10 LEDs are connected in series in the third LED group L13 that is connected in series with the first LED group L11 and the second LED group L12, when a voltage as high as a forward voltage V3 ((10+25+10)×Vf=45×3.2=144 (V)) is applied to the first LED group L11, the second LED group L12, and the third LED group L13, the LEDs included in the first LED group L11, the second LED group L12, and the third LED group L13 are turned on.

When the output voltage of the full-wave rectifier diode bridge circuit 122 is 0 (V) at time t0 (time t7), the output voltage does not reach a voltage that makes the LEDs in any of the first LED group L11, the second LED group L12, and the third LED group L13 turn on, and thus, all of the LEDs are not turned on.

When the output voltage of the full-wave rectifier diode bridge circuit 122 becomes the forward voltage V1 at time t1, the output voltage is a voltage enough for turning on the first LED group L11, the current Id starts to flow in the first bypass pathway 123, and the LEDs included in the first LED group L11 are turned on. At this time, the FET Q11 is in an ON state. At this time, the output voltage is not a voltage enough for turning on the second LED group L12 or the third LED group L13 that is connected in series with the first LED group L11, and thus, only the LEDs included in the first LED group L11 are turned on.

When the output voltage of the full-wave rectifier diode bridge circuit 122 becomes the forward voltage V2 at time t2, the output voltage is a voltage enough for turning on the first LED group L11 and the second LED group L12, the current Ie starts to flow, and the LEDs included in the first LED group L11 and the second LED group L12 are turned on. At this time, the FET Q12 is in an ON state. When the current Ie starts to flow, the current flowing in the resistor R11-2 is increased, the gate voltage of the FET Q11 is decreased in association with a voltage drop across the resistor R11-2, the FET Q11 transitions from the ON state to an OFF state, and the current Id flowing in the first bypass pathway 123 is limited.

When the output voltage of the full-wave rectifier diode bridge circuit 122 becomes the forward voltage V3 at time t3, the output voltage is a voltage enough for turning on the first LED group L11, the second LED group L12, and the third LED group L13, the current If starts to flow, and the LEDs included in the first LED group L11, the second LED group L12, and the third LED group L13 are turned on. At this time, the FET Q13 is in an ON state. When the current If starts to flow, the current flowing in the resistor R12-2 is increased, the gate voltage of the FET Q12 is decreased in association with a voltage drop across the resistor R12-2, the FET Q12 transitions from the ON state to an OFF state, and the current Ie flowing in the second bypass pathway 124 is limited. Since the current flowing in the resistor R11-2 is increased, the FET Q11 maintains the OFF state.

When the output voltage of the full-wave rectifier diode bridge circuit 122 becomes lower than the forward voltage V3 at time t4, the output voltage is not a voltage enough for turning on the first LED group L11, the second LED group L12, and the third LED group L13, and the current If does not flow. The current flowing in the resistor R12-2 is decreased, the gate voltage of the FET Q12 is increased, the FET Q12 transitions from the OFF state to the ON state, and the current Ie starts to flow in the second bypass pathway 124. Accordingly, the LEDs included in the third LED group L13 are turned off, and only the LEDs included in the first LED group L11 and the second LED group L12 are turned on.

When the output voltage of the full-wave rectifier diode bridge circuit 122 becomes lower than the forward voltage V2 at time t5, the output voltage is not a voltage enough for turning on the first LED group L11 and the second LED group L12, and the current Ie does not flow. The current flowing in the resistor R11-2 is decreased, the gate voltage of the FET Q11 is increased, the FET Q11 transitions from the OFF state to the ON state, and the current Id starts to flow in the first bypass pathway 123. Accordingly, the LEDs included in the second LED group L12 are turned off, and only the LEDs included in the first LED group L11 are turned on.

When the output voltage of the full-wave rectifier diode bridge circuit 122 becomes lower than the forward voltage V1 at time t6, the output voltage is not a voltage enough for turning on the first LED group L11, the current Id does not flow, and all of the LEDs are turned off. After that, the above-described states are repeated.

The operation of the LED driver circuit 20 illustrated in FIG. 1 (or the LED light emission device 200 configured by the LED driver circuit 20) will be described below in consideration of a difference from the LED driver circuit 120 in the LED driver system 100 for comparison illustrated in FIG. 5.

In an LED, when a voltage of a forward drop voltage (Vf) or more is applied to the LED, light having a luminous intensity approximately proportional to a forward current (If) is emitted. Therefore, in the case where n LEDs are connected in series, when a voltage of n×Vf or more is applied to the LEDs, the LEDs emit light. In addition, a rectified output voltage outputted from a diode bridge circuit that full-wave rectifies an alternating current supplied from a commercial power source repeats changes from 0 (V) to the maximum output voltage at a frequency twice a frequency of the commercial power source. Therefore, only when the rectified output voltage is n×Vf (threshold voltage) or more, the LEDs emit light, and when the rectified output voltage is less than n×Vf, the LEDs do not emit light, and the light emission period of the LEDs is shortened.

Thus, in the LED driver circuit 120, the LEDs are divided into three groups, and each of the groups is sequentially made to be turned on in response to a voltage from the rectified output voltage outputted from the diode bridge circuit 122 that full-wave rectifies an alternating current. Accordingly, the light emission period of the LEDs is lengthened.

In addition, a light equipment that is set to have a first color temperature during low-rate dimming by dimmer (during the low brightness range) and that is set to have a second color temperature higher than the first color temperature during 100% dimming is required.

For example, it is considered that the LED driver circuit 120 is set to have a color temperature of 2700 K during 100% dimming and have a red tinge during low-rate dimming so as to configure the above-described light fixture. Thus, in the LED driver circuit 120, the color temperature of light outputted from a phosphor-containing resin corresponding to the LEDs included in the first LED group L11 is made to be 1600 K, and the color temperature of light outputted from a phosphor-containing resin corresponding to the LEDs included in the second LED group L12 and the third LED group L13 is made to be 4000 K. In this case, during 100% dimming, a plurality of beams of emitted light is mixed, and the color temperature of the entire LED driver system 100 for comparison can be made to be approximately 2700 K. In addition, during low-rate dimming, 1600 K that is the color temperature of the light outputted from the phosphor-containing resin corresponding to the first LED group L11 is dominant, and the color temperature of the entire LED driver circuit 120 has a red tinge.

In general, when the color temperature becomes low, the conversion efficiency of a phosphor becomes extremely worse. For example, the conversion efficiency in the case of 1600 K is decreased by about 50% compared to that in the case of 2700 K. In the case of the LED driver circuit 120, the first LED group is made to cover 1600 K such that light of 1600 K is emitted during low-rate dimming so as to make the light of 1600 K be dominant during low-rate dimming. However, the LEDs included in the first LED group L11 are turned on at the forward voltage V1 or more, and are turned on during the longest period of time (from time t1 to time t6 in FIG. 6) among the three LED groups. In other words, in the LED driver circuit 120, the group having the lowest conversion efficiency needed to be used during the longest period of time, thereby worsening the efficiency of the entire driver circuit.

In addition, the LEDs included in the first LED group are turned on for the longest time in the LED driver circuit 120, and thus, the light having a color temperature of 1600 K needed to be considered also during 100% dimming.

In a similar way, it is considered that the LED driver circuit 20 is set to have a color temperature of 2700 K during 100% dimming and have a red tinge during low-rate dimming so as to configure the above-described light fixture. Thus, in the LED driver circuit 20, the color temperature of light outputted from the phosphor-containing resin 6 corresponding to the first LEDs included in the first LED group L1 is made to be 1600 K, and the color temperature of light outputted from the phosphor-containing resin 7 corresponding to the second LEDs included in the second LED group L2 and the third LED group L3 is made to be 2780 K. In this case, during 100% dimming, light of the first LEDs and light of the second LEDs are mixed, and the color temperature of the entire LED driver system 10 can be made to be approximately 2700 K. In addition, during low-rate dimming, 1600 K that is the color temperature of the light outputted from the phosphor-containing resin 6 corresponding to the first LEDs is dominant, and the color temperature of the entire LED driver circuit 20 (the LED light emission device 200 configured by the LED driver circuit 20) has a red tinge.

On the other hand, in the LED driver circuit 20, the first LEDs included in the first LED group L1 are turned on at the forward voltage V1 or more, but are turned off at the forward voltage V2 or more, and are turned off while the second LEDs included in the second LED group L2 and the third LED group L3 are turned on. In other words, the group having the worse conversion efficiency is used only when necessary (during low-rate dimming by dimmer), and thus, the light emission efficiency of the entire LED light emission device can be improved.

In addition, in the LED driver circuit 20, only the first LED group L1 is turned on during a period when the rectified output voltage is low, and thus, the light emission time of the first LED group is lengthened with respect to the entire light emission period during low-rate dimming, and 1600 K that is the first color temperature is dominant. In addition, the amount of light emission at a low color temperature is smaller than the amount of light emission at a high color temperature, and thus, 2780 K that is the second color temperature is dominant during 100% dimming. Therefore, a desired color temperature is easy to be set during 100% dimming, and the management of an emission color becomes easy.

The LED driver circuit 20 and the LED light emission device 200 illustrated in FIG. 1 are examples, and therefore changes, additions of components, and the like for performing the similar control method can be applied to them. In addition, the numbers of the LEDs included in the first LED group L1, the second LED group L2, and the third LED group L3 described regarding the LED driver system 10 are examples, and can be changed to the desired number appropriately. The types of the first LEDs included in the first LED group L1 and the second LEDs included in the second LED group L2 and the third LED group L3, and the types of the first phosphor-containing resin and the second phosphor-containing resin corresponding thereto, respectively, may be appropriately selected so as to have desired color temperatures.

Figure 7B:
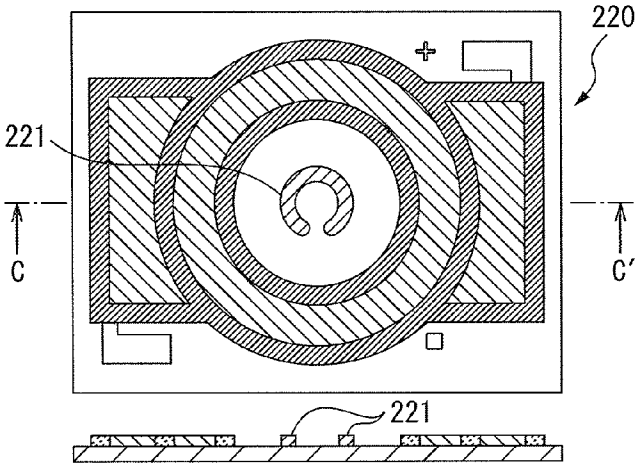
FIG. 7(*a*) is a plan view of an LED light emission device 210 according to another embodiment of the present invention and a cross-sectional view thereof along BB'.
Figure 7A:
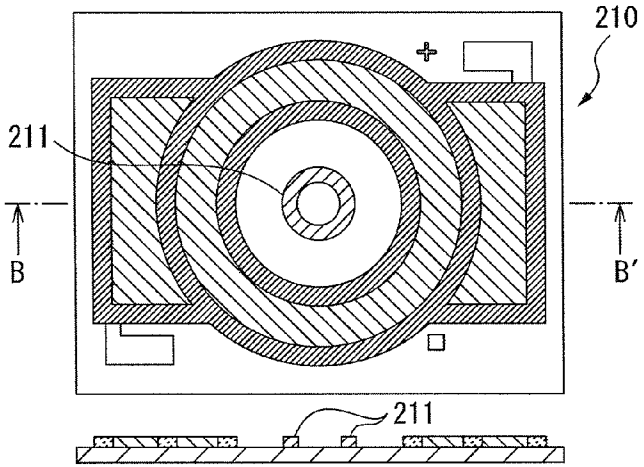
Figure 7C:
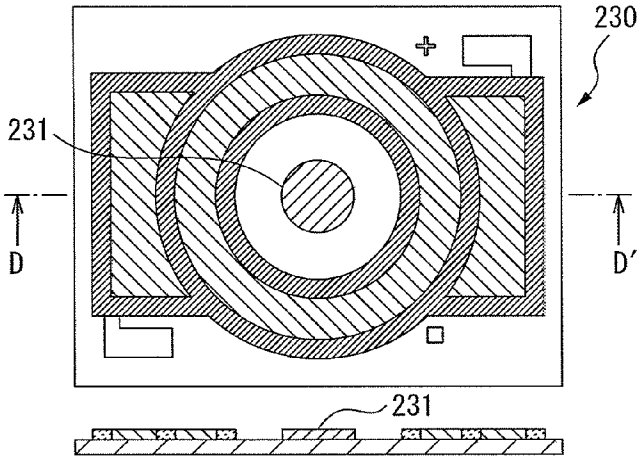

FIGS. 7(*a*) to 7(*c*) are diagrams illustrating LED light emission devices according to other embodiments of the present invention.

FIG. 7(*a*) is a plan view of another LED light emission device 210 and a cross-sectional view thereof along BB'. A difference between the LED light emission device 210 and the LED light emission device 200 illustrated in FIG. 3 is only a difference in shape between a first phosphor-containing resin 211 and the first phosphor-containing resin 6, and the rest is all the same. In other words, in FIG. 7(*a*), the first phosphor-containing resin 211 is formed into a doughnut shape on the substrate 1, and 10 first LEDs are arranged inside thereof. A front view and a side view are omitted because of being the same as FIG. 3(*c*) and FIG. 3(*d*). Similarly to the LED light emission device 200, the LED light emission device 210 is also configured with the LED driver circuit 20 illustrated in FIG. 1 as a light emission device.

FIG. 7(*b*) is a plan view of another LED light emission device 220 and a cross-sectional view thereof along CC'. A difference between the LED light emission device 220 and the LED light emission device 200 illustrated in FIG. 3 is only a difference in shape between a first phosphor-containing resin 221 and the first phosphor-containing resin 6, and the rest is all the same. In other words, in FIG. 7(*b*), the first phosphor-containing resin 221 is formed into a doughnut shape from which an arc is removed on the substrate 1, and 10 first LEDs are arranged inside thereof. A front view and a side view are omitted because of being the same as FIG. 3(*c*) and FIG. 3(*d*). Similarly to the LED light emission device 200, the LED light emission device 220 is also configured with the LED driver circuit 20 illustrated in FIG. 1 as a light emission device.

FIG. 7(*c*) is a plan view of another LED light emission device 230 and a cross-sectional view thereof along DD'. A difference between the LED light emission device 230 and the LED light emission device 200 illustrated in FIG. 3 is only a difference in shape between a first phosphor-containing resin 231 and the first phosphor-containing resin 6, and the rest is all the same. In other words, in FIG. 7(*c*), the first phosphor-containing resin 231 is formed into a circular shape on the substrate 1, and 10 first LEDs are arranged inside thereof. A front view and a side view are omitted because of being the same as FIG. 3(*c*) and FIG. 3(*d*). Similarly to the LED light emission device 200, the LED light emission device 230 is also configured with the LED driver circuit 20 illustrated in FIG. 1 as a light emission device.

Figure 8:
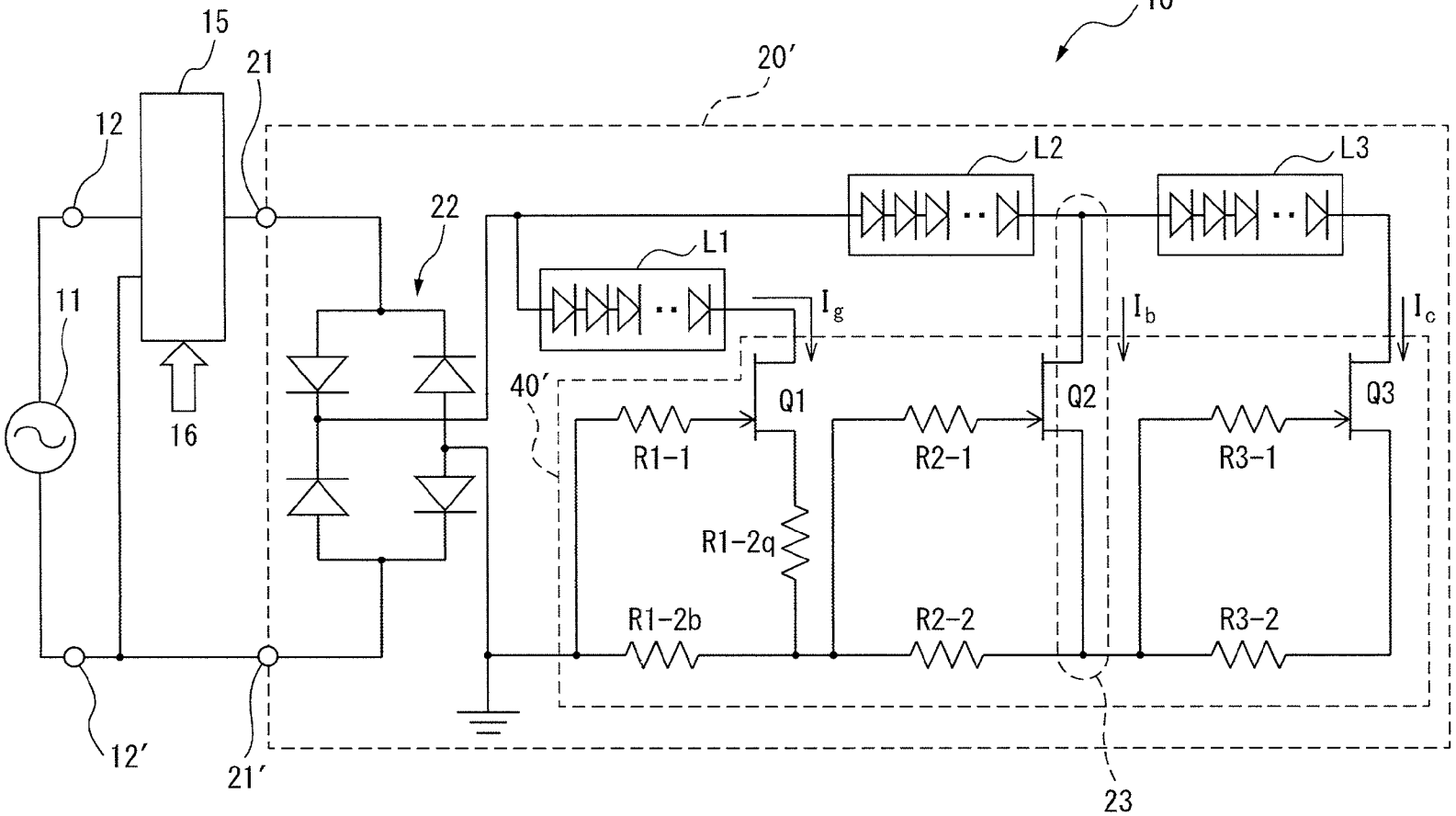
FIG. 8 is a diagram illustrating an LED driver system 10' according to another embodiment of the present invention.

FIG. 8 is a diagram illustrating an LED driver system 10' according to another embodiment of the present invention.

The LED driver system 10' illustrated in FIG. 8 and the LED driver system 10 illustrated in FIG. 1 are different only in that the resistor R1-2 is divided into a resistor R1-2*a* and a resistor R1-2*b*, and the resistor R1-2*a* is arranged between the FET Q1 and the resistor R1-2*b*. The LED driver system 10' includes an LED driver circuit 20', the LED driver circuit 20' includes a control unit 40', and a current flowing in the first LED group L1 is Ig. Other configurations in the LED driver system 10' illustrated in FIG. 8 are the same as those in the LED driver system 10 illustrated in FIG. 1, and thus, the description is omitted. In addition, the LED driver circuit 20' illustrated in FIG. 8 can also be configured as an LED light emission device, as illustrated in FIG. 3 and FIG. 7.

Figure 9:
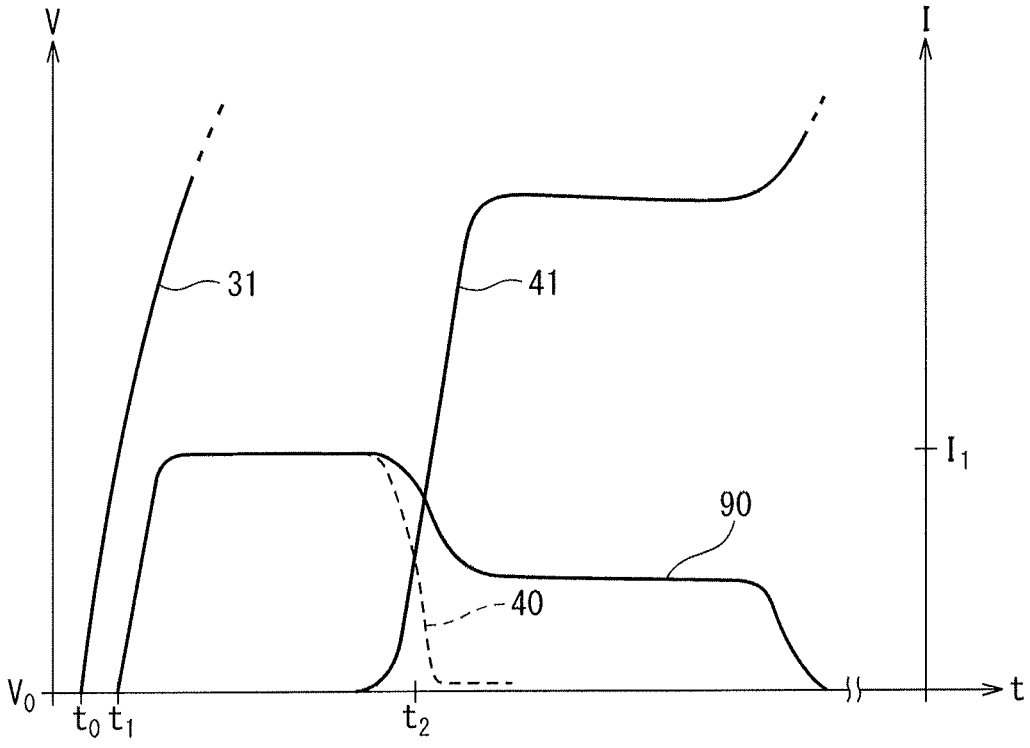
FIG. 9 is a diagram illustrating parts of current waveforms of an LED driver circuit 20'.

FIG. 9 is a diagram illustrating parts of current waveforms of the LED driver circuit 20'. A voltage waveform illustrated in FIG. 9 is a waveform regarding the LED driver circuit 20', which corresponds to the part, indicated by the dashed line E of the voltage waveform illustrated in FIG. 4.

The operation of the LED driver system 10' will be described below with reference to FIG. 9. In FIG. 9, a curve line 90 indicates a waveform of the current Ig flowing in the first LED group L1. In addition, in FIG. 9, the curve line 31, the curve line 40 indicated by a dotted line, and the curve line 41 are the same as those in the case of FIG. 4.

In the LED driver circuit 20 illustrated in FIG. 1, the current Ia flowing in the first LED group L1 is decreased sharply immediately before time t2, whereas the current Ib flowing in the second LED group L2 is increased sharply (refer to the curve line 40 and the curve line 41). On the other hand, in the LED driver circuit 20' illustrated in FIG. 8, since a voltage drop across the resistor R1-2*b* by the current Ib is small, when the current Ib starts to flow, the current Ig is decreased, and during a period when the current Ib becomes a constant current, the current Ig also maintains a constant current. In addition, when the current Ic starts to flow, the current Ig becomes 0 (V). In the output voltage decreasing phase of the full-wave rectifier diode bridge circuit 22, the reverse process is undergone. Although the LED driver circuit 20 illustrated in FIG. 1 and the LED driver circuit 20' illustrated in FIG. 8 are slightly different in the value of the current Ib actually, an important part in FIG. 9 is attenuation patterns of the current Ia and the current Ig, and the difference in the current Ib is ignored in FIG. 9.

Since the period of time during which the first LED group L1 is turned on is lengthened in the LED driver circuit 20' illustrated in FIG. 8, the number of the first LEDs can be reduced so as to obtain the same amount of light emission as that of the first LED group L1 in the LED driver circuit 20 illustrated in FIG. 1. In addition, since the current Ig is attenuated smoothly in the LED driver circuit 20', the control unit 40' controls the LED driver circuit 20' such that a period when only the first LED group L1 is turned on and a period when the first LED group L1 and the second LED group L2 are turned on concurrently are provided. According to the above, it was confirmed that, in the LED driver circuit 20', dimming-emission color properties more natural than those of the LED driver circuit 20 illustrated in FIG. 1 are obtained.

DESCRIPTION OF REFERENCE NUMERALS

1 substrate
2 first frame material
3 second frame material
4 third frame material
6 first phosphor-containing resin
7 second phosphor-containing resin
10, 10' LED driver system
15 phase control dimmer unit
20, 20' LED driver circuit
22 full-wave rectifier diode bridge circuit
40 control unit
200, 210, 220, 230 LED light emission device
L1 first LED group
L2 second LED group
L3 third LED group

The invention claimed is:

1. An LED driver circuit comprising:

a diode bridge rectifier circuit that full-wave rectifies the alternating current to output the rectified output voltage;

a first LED group, in which a plurality of first LEDs are connected in series and which is connected to the diode bridge rectifier circuit in parallel;

a second LED group, in which a plurality of second LEDs are connected in series and which is connected to the diode bridge rectifier circuit in parallel;

a third LED group, in which a plurality of the second LEDs are connected in series and which is connected to the second LED group in series;

a first phosphor-containing resin region that covers the first LED group, and converts a wavelength of light emitted from the first LED group to emit the light having a first color temperature;

a second phosphor-containing resin region that covers the second LED group and the third LED group, and converts a wavelength of light emitted from the second LED group and the third LED group to emit the light having a second color temperature; and a control unit that switches from a condition that only the first LED group is turning-on to a condition that only the second LED group is turning-on, and further, from the condition that only the second LED group is turning-on to a condition that the second LED group and the third LED group are turning-on in response to an increase in the rectified output voltage, wherein the number of the first LEDs included in the first LED group is smaller than the number of the second LEDs included in the second LED group, the control unit includes a bypass pathway arranged between the second LED group and the third LED group, and the control unit switches from the condition that only the first LED group is turning-on to the condition that only the second LED group is turning-on on the basis of a current flowing through the second LED group.

2. The LED driver circuit according to claim 1, further comprising a substrate and a first frame member which is arranged on the substrate into annual shape, wherein the first phosphor-containing resin region is disposed within the first frame member.

3. The LED driver circuit according to claim 2, further comprising further comprising a second frame member which is arranged outside of the first frame member on the substrate, wherein the second phosphor-containing resin region is disposed between the first frame member and the second frame member.

4. The LED driver circuit according to claim 2, wherein the first phosphor-containing resin region is disposed within the first frame member so as not to contact with the first frame member, and the second phosphor-containing resin region is disposed so as to cover the entire region between the first frame member and the second frame member.

5. The LED driver circuit according to claim 1, wherein a ratio of the number of the first LEDs connected in series and included in the first LED group to the number of the second LEDs connected in series and included in the second LED group is smaller than 1:3.

6. The LED driver circuit according to claim 1, wherein the control unit provide a condition that the first LED group and the second LED group are turning-on during a switching period from the condition that only the first LED group is turning-on to the condition that only the second LED group is turning-on in response to the increase in the rectified output voltage.

* * * * *